US005665691A

United States Patent [19]

France et al.

[11] Patent Number: 5,665,691

[45] Date of Patent: Sep. 9, 1997

[54] PROCESS FOR MAKING A LOW DENSITY DETERGENT COMPOSITION BY AGGLOMERATION WITH A HYDRATED SALT

[75] Inventors: Paul Amatt France; Larry Rudolph Genskow, both of West Chester, Ohio; Wayne Edward Beimesch, Covington, Ky.

[73] Assignee: The Procter & Gamble Company, Cincinnati, Ohio

[21] Appl. No.: 539,036

[22] Filed: Oct. 4, 1995

[51] Int. Cl.[6] ..... C11D 11/00

[52] U.S. Cl. ..... 510/444; 510/465; 510/507; 510/509; 510/510

[58] Field of Search ..... 252/89.1, 174, 252/135, 174.14, 174.25; 264/117, 140; 510/444, 465, 507, 509, 510

[56] References Cited

U.S. PATENT DOCUMENTS

| | | | |
|---|---|---|---|
| 3,640,875 | 2/1972 | Rubin et al. | 252/99 |
| 3,932,316 | 1/1976 | Sagel et al. | 252/532 |
| 3,986,987 | 10/1976 | D'Souza | 252/527 |
| 4,115,308 | 9/1978 | Guerry | 252/99 |
| 4,151,266 | 4/1979 | Robey et al. | 423/425 |
| 4,427,417 | 1/1984 | Porasik | 23/313 R |
| 4,818,424 | 4/1989 | Evans et al. | 252/91 |
| 4,820,441 | 4/1989 | Evans et al. | 252/174.24 |
| 4,900,466 | 2/1990 | Atkinson et al. | 252/174.14 |
| 4,992,079 | 2/1991 | Lutz | 23/313 R |
| 4,996,001 | 2/1991 | Ertle et al. | 252/99 |
| 5,080,848 | 1/1992 | Strauss et al. | 264/117 |
| 5,108,646 | 4/1992 | Beerse et al. | 252/174.25 |
| 5,133,924 | 7/1992 | Appel et al. | 264/342 R |
| 5,160,657 | 11/1992 | Bortolotti et al. | 252/174.14 |
| 5,205,958 | 4/1993 | Swatling et al. | 252/174.13 |
| 5,348,695 | 9/1994 | Ploumen et al. | 264/42 |
| 5,366,652 | 11/1994 | Capeci et al. | 252/89.1 |

FOREIGN PATENT DOCUMENTS

| | | |
|---|---|---|
| 886828 | 11/1971 | Canada . |
| 0 351 937 A1 | 1/1990 | European Pat. Off. . |
| 0 451 894 A1 | 10/1991 | European Pat. Off. . |
| 0510746 | 10/1992 | European Pat. Off. . |
| 1 517 713 | 7/1978 | United Kingdom . |
| 1 591 516 | 6/1981 | United Kingdom . |

OTHER PUBLICATIONS

Research Disclosure Apr. 1990, #312101, Detergent Powder Production.

*Primary Examiner*—Paul Lieberman
*Assistant Examiner*—Lorna M. Douyon
*Attorney, Agent, or Firm*—Ken K. Patel; Jacobus C. Rasser; Jerry J. Yetter

[57] ABSTRACT

A process for continuously preparing low density detergent agglomerate is provided. The process comprises the steps of: (a) agglomerating a detergent surfactant paste and dry starting detergent material in a high speed mixer to obtain detergent agglomerates, wherein the dry starting detergent material includes a hydrated salt; and (b) drying the detergent agglomerates so as to form the detergent composition having a density of less than about 600 g/l.

4 Claims, No Drawings

PROCESS FOR MAKING A LOW DENSITY DETERGENT COMPOSITION BY AGGLOMERATION WITH A HYDRATED SALT

FIELD OF THE INVENTION

The present invention generally relates to a process for producing a low density detergent composition. More particularly, the invention is directed to a process during which low density detergent agglomerates are produced by feeding a surfactant paste and dry starting detergent material into a high speed mixer followed by a drying apparatus. The process produces a free flowing, low density detergent composition which can be commercially sold as a conventional non-compact detergent composition or used as an admix in a low dosage, "compact" detergent product.

BACKGROUND OF THE INVENTION

Recently, there has been considerable interest within the detergent industry for laundry detergents which are "compact" and therefore, have low dosage volumes. To facilitate production of these so-called low dosage detergents, many attempts have been made to produce high bulk density detergents, for example with a density of 600 g/l or higher. The low dosage detergents are currently in high demand as they conserve resources and can be sold in small packages which are more convenient for consumers. However, the extent to which modem detergent products need to be "compact" in nature remains unsettled. In fact, many consumers, especially in developing countries, continue to prefer a higher dosage levels in their respective laundering operations. Consequently, there is a need in the art of producing modern detergent compositions for flexibility in the ultimate density of the final composition.

Generally, there are two primary types of processes by which detergent granules or powders can be prepared. The first type of process involves spray-drying an aqueous detergent slurry in a spray-drying tower to produce highly porous detergent granules. In the second type of process, the various detergent components are dry mixed after which they are agglomerated with a binder such as a nonionic or anionic surfactant. In both processes, the most important factors which govern the density of the resulting detergent granules are the density, shape, porosity and surface area of the various starting materials and their respective chemical composition. These parameters, however, can only be varied within a limited range. Thus, flexibility in the substantial bulk density can only be achieved by additional processing steps which lead to lower densities of the detergent granules.

There have been many attempts in the art for providing processes which increase the density of detergent granules or powders. Particular attention has been given to densification of spray-dried granules by post tower treatment. For example, one attempt involves a batch process in which spray-dried or granulated detergent powders containing sodium tripolyphosphate and sodium sulfate are densified and spheronized in a Marumerizer®. This apparatus comprises a substantially horizontal, roughened, rotatable table positioned within and at the base of a substantially vertical, smooth walled cylinder. This process, however, is essentially a batch process and is therefore less suitable for the large scale production of detergent powders. More recently, other attempts have been made to provide a continuous processes for increasing the density of "post-tower" or spray dried detergent granules. Typically, such processes require a first apparatus which pulverizes or grinds the granules and a second apparatus which increases the density of the pulverized granules by agglomeration. While these processes achieve the desired increase in density by treating or densifying "post tower" or spray dried granules, they do not provide a process which has the flexibility of providing lower density granules.

Moreover, all of the aforementioned processes are directed primarily for densifying or otherwise processing spray dried granules. Currently, the relative amounts and types of materials subjected to spray drying processes in the production of detergent granules has been limited. For example, it has been difficult to attain high levels of surfactant in the resulting detergent composition, a feature which facilitates production of detergents in a more efficient manner. Thus, it would be desirable to have a process by which detergent compositions can be produced without having the limitations imposed by conventional spray drying techniques.

To that end, the art is also replete with disclosures of processes which entail agglomerating detergent compositions. For example, attempts have been made to agglomerate detergent builders by mixing zeolite and/or layered silicates in a mixer to form free flowing agglomerates. While such attempts suggest that their process can be used to produce detergent agglomerates, they do not provide a mechanism by which a starting detergent materials in the form of pastes, liquids and dry materials can be effectively agglomerated into crisp, free flowing detergent agglomerates having low densities.

Accordingly, there remains a need in the art to have a process for continuously producing a low density detergent composition directly from starting detergent ingredients. Also, there remains a need for such a process which is more efficient, flexible and economical to facilitate large-scale production of detergents of low as well as high dosage levels.

BACKGROUND ART

The following references are directed to densifying spray-dried granules: Appel et al, U.S. Pat. No. 5,133,924 (Lever); Bortolotti et al, U.S. Pat. No. 5,160,657 (Lever); Johnson et al, British patent No. 1,517,713 (Unilever); and Curtis, European Patent Application 451,894. The following references are directed to producing detergents by agglomeration: Beerse et al, U.S. Pat. No. 5,108,646 (Procter & Gamble); Capeci et al, U.S. Pat. No. 5,366,652 (Procter & Gamble); Hollingsworth et al, European Patent Application 351,937 (Unilever); and Swatling et al, U.S. Pat. No. 5,205,958.

SUMMARY OF THE INVENTION

The present invention meets the aforementioned needs in the art by providing a process which produces a low density (less than about 600 g/l) detergent composition directly from starting ingredients. The process does not use the conventional spray drying towers currently used and is therefore more efficient, economical and flexible with regard to the variety of detergent compositions which can be produced in the process. Moreover, the process is more amenable to environmental concerns in that it does not use spray drying towers which typically emit particulates and volatile organic compounds into the atmosphere.

As used herein, the term "agglomerates" refers to particles formed by agglomerating detergent granules or particles which typically have a smaller mean particle size than the formed agglomerates. As used herein, the phrase "at least a minor amount" of water means an amount sufficient to aid in agglomeration, typically on the order of 0.5% to about 10% by weight of the total amount of water contained in the mixture of all starting components. All percentages used herein are expressed as "percent-by-weight" unless indicated otherwise. All viscosities described herein are measured at 70° C. and at shear rates between about 10 to 50 $sec^{-1}$, preferably at 25 $sec^{-1}$.

In accordance with one aspect of the invention, a process for preparing low density detergent agglomerates having a density of below about 500 g/l is provided. The process comprises the steps of: (a) agglomerating a detergent surfactant paste and dry starting detergent material in a high speed mixer to obtain detergent agglomerates, wherein the dry starting detergent material includes a hydrated salt; and (b) drying the detergent agglomerates so as to form the detergent composition having a density of less than about 600 g/l.

In accordance with another aspect of the invention, another process for preparing low density detergent agglomerates having a density of below about 500 g/l is provided. The process comprises the steps of: (a) agglomerating a detergent surfactant paste and dry starting detergent material in a high speed mixer to obtain detergent agglomerates, wherein the dry starting detergent material includes a hydrated salt selected from the group consisting of citric acid, hydrated sulfates, hydrated carbonates, hydrated bicarbonates, borax pentahydrates, Afghanite, Andersonite, AshcroftineY, Carletonite, DonnayiteY, Ferrisurite, Franzinite, Gaylussite, Girvasite, Jouravskite, KamphaugiteY, Lepersonnite Gd, Liottite, MckelveyiteY, Sacrofanite, Schrockingerite, Tuscanite, Tyrolite, Vishnevite and mixtures thereof; (b) mixing the detergent agglomerates in a moderate speed mixer to further agglomerate the detergent agglomerates; and (c) drying the detergent agglomerates so as to form the low density detergent composition having a density of less than about 500 g/l. The low density detergent composition made by any of the process embodiments described herein is also provided.

Accordingly, it is an object of the invention to provide a process for continuously producing a low density detergent composition directly from starting detergent ingredients. It is also an object of the invention to provide a process which is more efficient, flexible and economical to facilitate large-scale production of detergents of low as well as high dosage levels. These and other objects, features and attendant advantages of the present invention will become apparent to those skilled in the art from a reading of the following detailed description of the preferred embodiment and the appended claims.

DETAILED DESCRIPTION OF THE PREFERRED EMBODIMENT

The present invention is directed to a process which produces free flowing, low density detergent agglomerates having a density of below about 600 g/l. The process produces low density detergent agglomerates from a highly viscous surfactant paste having a relatively high water content, typically at least about 10%. Generally speaking, the present process is used in the production of normal as opposed to low dosage detergents whereby the resulting detergent agglomerates can be used as a detergent or as a detergent additive. It should be understood that the process described herein can be continuous or batch depending upon the desired application.

Process

In the first step of the process, starting detergent materials are fed into a mixer for agglomeration. To achieve the desired density of below 600 g/l, the agglomeration step is carried forth initially in a high speed mixer after which an optional moderate speed mixer may follow if further agglomeration is desired. The starting detergent materials are agglomerated in the presence of a hydrated salt as described more fully hereinafter to produce agglomerate particles having a density of below about 600 g/l and, more preferably less than about 500 g/l and most preferably from about 300 g/l to about 450 g/l. The nature and composition of the entering or starting detergent materials can vary as described in detail hereinafter. Preferably, the mean residence time of the starting detergent materials in the high speed mixer (e.g. Lodige Recycler CB 30 or other similar equipment) is from about 2 to 45 seconds while the residence time in the optional low or moderate speed mixer (e.g. Lodige Recycler KM 300 "Ploughshare" or other similar equipment) is from about 0.5 to 15 minutes.

The starting detergent materials preferably include a highly viscous surfactant paste and dry detergent material, the components of which are described more fully hereinafter. For purposes of facilitating the production of low density or "fluffy" detergent agglomerates, the dry detergent material includes a hydrated salt material which surprisingly has been found to lower the density of the agglomerates produced in the process. It should be understood that the hydrated salt can be physically included in the surfactant paste which also is suitable and within the scope of the instant process invention. While not intending to be bound by theory, it is believed that this hydrated salt enhances the "fluffing" or "puffing" of the agglomerates as they are dried in the apparatus described hereinafter. This leads to the production of agglomerates having the desired low density. To that end, the instant process preferably entails mixing from about 1% to about 20%, more preferably from about 3% to about 10% of a hydrated salt material into the high speed mixer.

The other essential step in the process involves drying the agglomerates exiting the high speed mixer or moderate speed mixer if it is optionally used. This can be completed in a wide variety of apparatus including but not limited to fluid bed dryers. The drying step enhances the free flowability of the agglomerates and prompts or initiates the "fluffy" or "puffy" physical characteristics of the resulting agglomerates. While not intending to be bound by theory, it is believed that during the drying step of the instant process, the hydrated salt embodied in the agglomerated dry extremely quickly and "puff" into a fluffy, light, low density agglomerate particle. Accordingly, sufficient drying must occur in order to produce the desired low density agglomerates. In that regard, the drying temperature used in the whichever drying apparatus will preferably be from about 50° C. to about 300° C., more preferably from about 80° C. to about 250° C., and most preferably, from about 100° C. to about 250° C.

The detergent agglomerates produced by the process preferably have a surfactant level of from about 20% to about 55%, more preferably from about 35% to about 55% and, most preferably from about 45% to about 55%. The particle porosity of the resulting detergent agglomerates produced according to the process of the invention is preferably in a range from about 5% to about 50%, more preferably at about 25%. In addition, an attribute of dense or densified agglomerates is the relative particle size. The present process typically provides detergent agglomerates having a mean particle size of from about 250 microns to about 1000 microns, and more preferably from about 400 microns to about 600 microns. As used herein, the phrase "mean particle size" refers to individual agglomerates and not individual particles or detergent granules. The combination of the above-referenced porosity and particle size results in agglomerates having density values of below 500 g/l. Such a feature is especially useful in the production of laundry detergents having varying dosage levels as well as other granular compositions such as dishwashing compositions.

Optional Process Steps

In an optional step of the present process, the detergent agglomerates exiting the fluid bed dryer are further conditioned by cooling the agglomerates in a fluid bed cooler or similar apparatus as are well known in the art. Another optional process step involves adding a coating agent to improve flowability and/or minimize over agglomeration of the detergent composition in one or more of the following locations of the instant process: (1) the coating agent can be added directly after the fluid bed cooler; (2) the coating agent may be added between the fluid bed dryer and the fluid bed cooler; (3) the coating agent may be added between the fluid bed dryer and the moderate speed mixer; and/or (4) the coating agent may be added directly to the moderate speed mixer and the fluid bed dryer. The coating agent is preferably selected from the group consisting of aluminosilicates, silicates, carbonates and mixtures thereof. The coating agent not only enhances the free flowability of the resulting detergent composition which is desirable by consumers in that it permits easy scooping of detergent during use, but also serves to control agglomeration by preventing or minimizing over agglomeration, especially when added directly to the moderate speed mixer. As those skilled in the art are well aware, over agglomeration can lead to very undesirable flow properties and aesthetics of the final detergent product.

Optionally, the process can comprise the step of spraying an additional binder in one or both of the mixer or fluid bed dryers. A binder is added for purposes of enhancing agglomeration by providing a "binding" or "sticking" agent for the detergent components. The binder is preferably selected from the group consisting of water, anionic surfactants, nonionic surfactants, polyethylene glycol, polyvinyl pyrrolidone polyacrylates, citric acid and mixtures thereof. Other suitable binder materials including those listed herein are described in Beerse et al, U.S. Pat. No. 5,108,646 (Procter & Gamble Co.), the disclosure of which is incorporated herein by reference.

Other optional steps contemplated by the present process include screening the oversized detergent agglomerates in a screening apparatus which can take a variety of forms including but not limited to conventional screens chosen for the desired particle size of the finished detergent product.

Other optional steps include conditioning of the detergent agglomerates by subjecting the agglomerates to additional drying in the one of the aforementioned drying apparatus.

Another optional step of the instant process entails finishing the resulting detergent agglomerates by a variety of processes including spraying and/or admixing other conventional detergent ingredients. For example, the finishing step encompasses spraying perfumes, brighteners and enzymes onto the finished agglomerates to provide a more complete detergent composition. Such techniques and ingredients are well known in the art.

Detergent Surfactant Paste

The detergent surfactant paste used in the process is preferably in the form of an aqueous viscous paste, although forms are also contemplated by the invention. This so-called viscous surfactant paste has a viscosity of from about 5,000 cps to about 100,000 cps, more preferably from about 10,000 cps to about 80,000 cps, and contains at least about 10% water, more preferably at least about 20% water. The viscosity is measured at 70° C. and at shear rates of about 10 to 100 sec.$^{-1}$. Furthermore, the surfactant paste, if used, preferably comprises a detersive surfactant in the amounts specified previously and the balance water and other conventional detergent ingredients.

The surfactant itself, in the viscous surfactant paste, is preferably selected from anionic, nonionic, zwitterionic, ampholytic and cationic classes and compatible mixtures thereof. Detergent surfactants useful herein are described in U.S. Pat. No. 3,664,961, Norris, issued May 23, 1972, and in U.S. Pat. No. 3,919,678, Laughlin et al., issued Dec. 30, 1975, both of which are incorporated herein by reference. Useful cationic surfactants also include those described in U.S. Pat. No. 4,222,905, Cockrell, issued Sep. 16, 1980, and in U.S. Pat. No. 4,239,659, Murphy, issued Dec. 16, 1980, both of which are also incorporated herein by reference. Of the surfactants, anionics and nonionics are preferred and anionics are most preferred.

Nonlimiting examples of the preferred anionic surfactants useful in the surfactant paste include the conventional $C_{11}$–$C_{18}$ alkyl benzene sulfonates ("LAS"), primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)CH_3$ and $CH_3(CH_2)_y(CHOSO_3^-M^+)CH_2CH_3$ where x and (y+1) are integers of at least about 7, preferably at least about 9, and M is a water-solubilizing cation, especially sodium, unsaturated sulfates such as oleyl sulfate, and the $C_{10}$–$C_{18}$ alkyl alkoxy sulfates ("$AE_xS$"; especially EO 1–7 ethoxy sulfates).

Optionally, other exemplary surfactants useful in the paste of the invention include and $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

Dry Detergent Material

The starting dry detergent material of the present process preferably comprises hydrated salt. In one preferred embodiment, the hydrated salt is selected from the group consisting of citric acid, hydrated sulfates, hydrated carbonates, hydrated bicarbonates, borax pentahydrates and mixtures thereof. In another preferred embodiment, the hydrated salt is selected from the group consisting of Afghanite, Andersonite, AshcroftineY, Carletonite, DonnayiteY, Ferrisurite, Franzinite, Gaylussite, Girvasite, Jouravskite, KamphaugiteY, Lepersonnite Gd, Liottite, MckelveyiteY, Sacrofanite, Schrockingerite, Tuscanite, Tyrolite, Vishnevite, and mixtures thereof. The aforementioned materials are cross-referenced with their respective chemical formulas below:

Afghanite, $(Na,Ca,K)_8(Si,Al)_{12}O_{24}(SO_4,Cl,CO_3)_3\cdot(H_2O)$;

Andersonite, $Na_2Ca(UO_2)(CO_3)_3\cdot 6(H_2O)$;

AshcroftineY, $K_5Na_5(Y,Ca)_{12}Si_{28}O_{70}(OH)_2(CO_3)_8\cdot n(H_2O)$, wherein n is 3 or 8;

Carletonite, $KNa_4Ca_4Si_8O_{18}(CO_3)_4(OH,F)\cdot(H_2O)$;

DonnayiteY, $Sr_3NaCaY(CO_3)_6\cdot 3(H_2O)$;

Ferrisurite, $(Pb,Ca)_3(CO_3)_2(OH,F)(Fe,Al)_2Si_4O_{10}(OH)_2\cdot n(H_2O)$, wherein n is an integer from 1 to 20;

Franzinite, $(Na,Ca)_7(Si,Al)_{12}O_{24}(SO_4,CO_3,OH,Cl)_3\cdot(H_2O)$;

Gaylussite, $Na_2Ca(CO_3)_2\cdot 5(H_2O)$;

Girvasite, $NaCa_2Mg_3(PO_4)_2[PO_2(OH)_2](CO_3)(OH)_2\cdot 4(H_2O)$;

Jouravskite, $Ca_6Mn_2(SO_4,CO_3)_4(OH)_{12}\cdot n(H_2O)$, wherein n is 24 or 26;

KamphaugiteY, $CaY(CO_3)_2(OH)\cdot(H_2O)$;

LepersonniteGd, $Ca(Gd,Dy)_2(UO_2)_{24}(CO_3)_8(Si_4O_{12})O_{16}\cdot 60(H_2O)$;

Liottite, $(Ca,Na,K)_8(Si,Al)_{12}O_{24}(SO_4,CO_3,Cl,OH)_4\cdot n(H_2O)$, wherein n is 1 or 2;

MckelveyiteY, $Ba_3Na(Ca,U)Y(CO_3)_6\cdot 3(H_2O)$;

Sacrofanite, $(Na,Ca,K)_9(Si,Al)_{12}O_{24}[(OH)_2,SO_4,CO_3,Cl_2]_x\cdot n(H_2O)$, wherein x is 3 or 4 and n is an integer from 1 to 20;

Schrockingerite, $NaCa_3(UO_2)(CO_3)_3(SO_4)F\cdot 10(H_2O)$;

Tuscanite, $K(Ca,Na)_6(Si,Al)_{10}O_{22}[SO_4,CO_3,(OH)_2]\cdot(H_2O)$;

Tyrolite, $CaCu_5(AsO_4)_2(CO_3)(OH)_4\cdot 6(H_2O)$; and

Vishnevite, $(Na,Ca,K)_6(Si,Al)_{12}O_{24}(SO_4,CO_3,Cl_2)_{2-4}\cdot n(H_2O)$.

Still another preferred embodiment involves selecting the hydrated salt from a either of the aforementioned lists. While the hydrated salts listed herein are suitable for use in the instant process, other hydrated salts which have not been listed can be used as well provided they are organic or inorganic materials that are or have been hydrated with at least one water of hydration.

The dry detergent material also preferably includes a detergent aluminosilicate builder which are referenced as aluminosilicate ion exchange materials and sodium carbonate. The aluminosilicate ion exchange materials used herein as a detergent builder preferably have both a high calcium ion exchange capacity and a high exchange rate. Without intending to be limited by theory, it is believed that such high calcium ion exchange rate and capacity are a function of several interrelated factors which derive from the method by which the aluminosilicate ion exchange material is produced. In that regard, the aluminosilicate ion exchange materials used herein are preferably produced in accordance with Corkill et at, U.S. Pat. No. 4,605,509 (Procter & Gamble), the disclosure of which is incorporated herein by reference.

Preferably, the aluminosilicate ion exchange material is in "sodium" form since the potassium and hydrogen forms of the instant aluminosilicate do not exhibit the as high of an exchange rate and capacity as provided by the sodium form. Additionally, the aluminosilicate ion exchange material preferably is in over dried form so as to facilitate production of crisp detergent agglomerates as described herein. The aluminosilicate ion exchange materials used herein preferably have particle size diameters which optimize their effectiveness as detergent builders. The term "particle size diameter" as used herein represents the average particle size diameter of a given aluminosilicate ion exchange material as determined by conventional analytical techniques, such as microscopic determination and scanning electron microscope (SEM). The preferred particle size diameter of the aluminosilicate is from about 0.1 micron to about 10 microns, more preferably from about 0.5 microns to about 9 microns. Most preferably, the particle size diameter is from about 1 microns to about 8 microns.

Preferably, the aluminosilicate ion exchange material has the formula $$Na_z[(AlO_2)_z\cdot(SiO_2)_y]xH_2O$$

wherein z and y are integers of at least 6, the molar ratio of z to y is from about 1 to about 5 and x is from about 10 to about 264. More preferably, the aluminosilicate has the formula $$Na_{12}[(AlO_2)_{12}\cdot(SiO_2)_{12}]xH_2O$$

wherein x is from about 20 to about 30, preferably about 27. These preferred aluminosilicates are available commercially, for example under designations Zeolite A, Zeolite B and Zeolite X. Alternatively, naturally-occurring or synthetically derived aluminosilicate ion exchange materials suitable for use herein can be made as described in Krummel et al, U.S. Pat. No. 3,985,669, the disclosure of which is incorporated herein by reference.

The aluminosilicates used herein are further characterized by their ion exchange capacity which is at least about 200 mg equivalent of $CaCO_3$ hardness/gram, calculated on an anhydrous basis, and which is preferably in a range from about 300 to 352 mg equivalent of $CaCO_3$ hardness/gram. Additionally, the instant aluminosilicate ion exchange materials are still further characterized by their calcium ion exchange rate which is at least about 2 grains $Ca^{++}$/gallon/minute/-gram/gallon, and more preferably in a range from about 2 grains $Ca^{++}$/gallon/minute/-gram/gallon to about 6 grains $Ca^{++}$/gallon/minute/-gram/gallon.

Adjunct Detergent Ingredients

The starting dry detergent material in the present process can include additional detergent ingredients and/or, any number of additional ingredients can be incorporated in the detergent composition during subsequent steps of the present process. These adjunct ingredients include other detergency builders, bleaches, bleach activators, suds boosters or suds suppressors, anti-tarnish and anti-corrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Other builders can be generally selected from the various water-soluble, alkali metal, ammonium or substituted ammonium phosphates, polyphosphates, phosphonates, polyphosphonates, carbonates, borates, polyhydroxy sulfonates, polyacetates, carboxylates, and polycarboxylates. Preferred are the alkali metal, especially sodium, salts of the above. Preferred for use herein are the phosphates, carbonates, $C_{10-18}$ fatty acids, polycarboxylates, and mixtures thereof. More preferred are sodium tripolyphosphate, tetrasodium pyrophosphate, citrate, tartrate mono- and di-succinates, and mixtures thereof (see below).

In comparison with amorphous sodium silicates, crystalline layered sodium silicates exhibit a clearly increased calcium and magnesium ion exchange capacity. In addition, the layered sodium silicates prefer magnesium ions over calcium ions, a feature necessary to insure that substantially all of the "hardness" is removed from the wash water. These crystalline layered sodium silicates, however, are generally more expensive than amorphous silicates as well as other builders. Accordingly, in order to provide an economically feasible laundry detergent, the proportion of crystalline layered sodium silicates used must be determined judiciously.

The crystalline layered sodium silicates suitable for use herein preferably have the formula $$NaMSi_xO_{2x+1}.yH_2O$$

wherein M is sodium or hydrogen, x is from about 1.9 to about 4 and y is from about 0 to about 20. More preferably, the crystalline layered sodium silicate has the formula $$NaMSi_2O_5.yH_2O$$

wherein M is sodium or hydrogen, and y is from about 0 to about 20. These and other crystalline layered sodium silicates are discussed in Corkill et al, U.S. Pat. No. 4,605,509, previously incorporated herein by reference.

Specific examples of inorganic phosphate builders are sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1, 1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Examples of nonphosphorus, inorganic builders are tetraborate decahydrate and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylene malonic acid. Some of these materials are useful as the water-soluble anionic polymer as hereinafter described, but only if in intimate admixture with the non-soap anionic surfactant.

Other suitable polycarboxylates for use herein are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both of which arc incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et at., issued May 5, 1987, the disclosure of which is incorporated herein by reference.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. Nos. 3,933,672, issued Jan. 20, 1976 to Bartoletta et al., and 4,136,045, issued Jan. 23, 1979 to Gault et al., both incorporated herein by reference.

Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

In order to make the present invention more readily understood, reference is made to the following examples, which are intended to be illustrative only and not intended to be limiting in scope.

EXAMPLE I

This Example illustrates a batch mode of the instant process. A low density agglomerated detergent composition is prepared using a Cuisenart™ food processor which is a high speed mixer. The mixer is first charged with a mixture of dry detergent powders, namely sodium carbonate (mean particle size 5–30 microns made via Air Classified Mill), light density sodium tripolyphosphate (supplied by FMC Corporation) and Borax Pentahydrate unpuffed (supplied by USBORAX). An aqueous surfactant paste comprising 70% by weight sodium alkyl sulfate derived from coconut oil ($C_nAS$) and 30% water, is then added on top of the powder mixture while the mixer is being operated for 15 seconds at high speed. The $C_nAS$ formula is $C_xH_yOSO_3Na$ where x=12, 14 and 16 and y=2x+1. The surfactant paste is added until discrete agglomerates or granules are formed in the mixer. The wet agglomerates are then transferred to a Niro™ fluid bed dryer. The agglomerates are dried at a bed air temperature of 200° C. with an airflow of 0.98 m/s until an exhaust temperature of 158° C. is reached.

The composition of the agglomerates are given below in Table I.

TABLE I

| (% weight) | |
|---|---|
| Component | I |
| CnAS | 34.0 |
| Fine sodium carbonate | 20.6 |
| STPP | 24.8 |
| Borax Pentahydrate ("unpuffed")* | 20.6 |
| Bulk Density before drying (g/l) | 627 |
| Bulk Density after drying (g/l) | 363 |

*The "unpuffed" aspect of this pentahydrate indicates that it is not dried, but is in its hydrated state The resulting agglomerates unexpectedly have a bulk density after drying of 363 g/l and showed good cake strength and flowability.

COMPARATIVE EXAMPLES II–III

These Examples are prepared by the process described in Example I, but do not contain a hydrated salt and therefore presented herein for purposes of comparison. The following compositions were made as shown in Table II.

TABLE II

| (% weight) | | |
|---|---|---|
| Component | II | III |
| CnAS | 39 | 33.8 |
| Fine sodium carbonate | 30.5 | 20.6 |
| STPP | 30.5 | 25.0 |
| Borax Pentahydrate ("puffed")* | — | 20.6 |
| Bulk Density before drying (g/l) | 565 | 572 |
| Density after drying (g/l) | 561 | 588 |

*The "puffed" aspect of this pentahydrate indicates that it had been dried prior to use in the process. The resulting agglomerates have a bulk density that is considerably higher as the particles do not "puff" upon drying to a lower density since a hydrated salt is not used in the process. Example III uses a dried or "puffed" borax pentahydrate which is not hydrated.

Having thus described the invention in detail, it will be obvious to those skilled in the art that various changes may be made without departing from the scope of the invention and the invention is not to be considered limited to what is described in the specification.

What is claimed is:

1. A process for preparing a low density detergent composition comprising the steps of:

(a) agglomerating a detergent surfactant paste and dry starting detergent material in a high speed mixer to obtain detergent agglomerates, wherein the mean residence time of said detergent agglomerates in said high speed mixer is in a range from about 2 seconds to about 45 seconds, said dry starting detergent material includes from about 3% to about 20% of unpuffed borax pentahydrate that has not been dried, sodium carbonate and phosphate;

(b) mixing said detergent agglomerates in a moderate speed mixer to further agglomerate said detergent agglomerates, wherein the mean residence time of said detergent agglomerates in said moderate speed mixer is in range from about 0.5 minutes to about 15 minutes: and (c) drying said detergent agglomerates so as to form said detergent composition having a surfactant level of from about 20% to about 55% and having a density of from about 300 g/l to about 450 g/l.

2. A process according to claim 1 wherein said dry starting material further comprises a builder selected from the group consisting of aluminosilicates, crystalline layered silicates, and mixtures thereof.

3. A process according to claim 1 wherein said surfactant paste has a viscosity of from about 5,000 cps to about 100,000 cps.

4. A process according to claim 1 wherein said surfactant paste comprises water and a surfactant selected from the group consisting of anionic, nonionic, zwitterionic, ampholytic and cationic surfactants and mixtures thereof.

* * * * *